US010279279B2

(12) United States Patent
Baranoff

(10) Patent No.: US 10,279,279 B2
(45) Date of Patent: May 7, 2019

(54) SELF-LEVELING BUBBLE PRODUCING SYSTEM

(71) Applicant: Sergei Baranoff, West Sacramento, CA (US)

(72) Inventor: Sergei Baranoff, West Sacramento, CA (US)

( * ) Notice: Subject to any disclaimer, the term of this patent is extended or adjusted under 35 U.S.C. 154(b) by 0 days.

(21) Appl. No.: 15/959,081

(22) Filed: Apr. 20, 2018

(65) Prior Publication Data

US 2018/0304168 A1 Oct. 25, 2018

Related U.S. Application Data

(60) Provisional application No. 62/488,145, filed on Apr. 21, 2017.

(51) Int. Cl.

| | |
|---|---|
| ***A63H 33/28*** | (2006.01) |
| ***A63B 43/00*** | (2006.01) |
| ***A63H 33/00*** | (2006.01) |
| *A63H 29/02* | (2006.01) |
| *A63H 1/08* | (2006.01) |

(52) U.S. Cl.

CPC ..... *A63H 33/28* (2013.01); *A63B 43/00* (2013.01); *A63H 33/005* (2013.01); *A63H 1/08* (2013.01); *A63H 29/02* (2013.01)

(58) Field of Classification Search

CPC ..... A63H 33/28

See application file for complete search history.

(56) References Cited

U.S. PATENT DOCUMENTS

| | | | | |
|---|---|---|---|---|
| 5,277,641 | A | 1/1994 | Gable et al. | |
| 5,857,351 | A | 1/1999 | Angus et al. | |
| RE39,443 | E * | 12/2006 | Schramm | A63H 33/28 141/98 |
| RE42,610 | E * | 8/2011 | Schramm | B65D 23/00 141/336 |
| 8,029,393 | B2 | 10/2011 | Frazier | |
| 2002/0061697 | A1 | 4/2002 | Hornsby et al. | |
| 2006/0046606 | A1 | 3/2006 | Martin et al. | |

(Continued)

OTHER PUBLICATIONS

US 9,342,073 B2, 05/2016, Bernstein et al. (withdrawn)

PCT International Search Report and Written Opinion, PCT Application No. PCT/US2018/028678, dated Jul. 6, 2018, 26 Pages.

*Primary Examiner* — John Ricci

(74) *Attorney, Agent, or Firm* — Fenwick & West LLP

(57) ABSTRACT

A system produces bubbles. The system may be used as a children's toy, a special effects machine, an art performance prop, a party entertainment item, or a similar object for entertaining users. The system is designed to produce bubbles regardless of the orientation of the system. The system includes a reservoir, a pump, a swiping mechanism, and a fan. The reservoir receives and stores fluid, and the pump provides pressure on the stored fluid such that the fluid travels through the reservoir and exits the reservoir. The swiping mechanism spreads across the exited fluid to create a fluid sheet, and the fan blows on the fluid sheet, transforming it into a bubble. The pump enables the stored fluid to be available for bubble production at any orientation of the system. The system may be moved, rotated, thrown, bounced, swung, etc. by a user and produce bubbles during its motion.

20 Claims, 7 Drawing Sheets

(56) References Cited

U.S. PATENT DOCUMENTS

| | | | | |
|---|---|---|---|---|
| 2006/0163278 | A1* | 7/2006 | Yeung | A63H 33/28 222/79 |
| 2007/0275630 | A1* | 11/2007 | Thai | A63H 33/28 446/15 |
| 2009/0163109 | A1 | 6/2009 | Thai | |
| 2011/0111896 | A1 | 5/2011 | Frazier | |
| 2012/0208426 | A1* | 8/2012 | Kuo | A63H 33/28 446/15 |
| 2014/0141688 | A1* | 5/2014 | Kelly | A63H 33/28 446/15 |
| 2014/0364032 | A1* | 12/2014 | Kelly | A63H 33/28 446/15 |

* cited by examiner

SELF-LEVELING BUBBLE PRODUCING SYSTEM

CROSS REFERENCE TO RELATED APPLICATIONS

This application claims the benefit of U.S. Provisional Application No. 62/488,145, filed Apr. 21, 2017, which is incorporated by reference in its entirety.

BACKGROUND

This invention relates generally to children's toys and more particularly to a bubble producing system.

Presently, bubble producing toys are limited in their application due to the need to draw fluid from a reservoir that is typically a tank, in which the fluid is capable of freely sloshing around, and is placed at a lower portion of the toy. As a result, the fluid may become aerated and cause air bubbles such that there is not a continuous flow of fluid available to other components for bubble production. In addition, this configuration of the fluid reservoir creates an unbalanced center of gravity and limits the movement capabilities of the toy, often requiring the toy to be in a fixed position when making bubbles. Due to this configuration, bubble producing toys are limited in due to the inability to move between varied planes of space and operate in various orientations.

Without alternative options for bubble producing toys, the user has been forced to deal with such problems. While some effort has been made to make bubble producing toys more user friendly and engaging, some of the adjustments to bubble producing toys include colored lights, integration of sound, novelty shapes, and automated triggers. However, each of these approaches fail to address the limited movement capabilities of the bubble producing toys. For example, colored lights simply improve the aesthetics of the toy. Sound and automated triggers again add to a user's enjoyment with the toy but do not address a user's need to retain a single plane orientation of the toy. Novelty shapes change the visual depiction of the toy but again do not address the user's need to maintain and operate the toy in a single plane.

Accordingly, there is a longstanding need for an effective, multi-configurable system that lessens or eliminates a user's need to maintain a flat plane while using bubble producing toys, allowing the toy to be moved about while enabling the bubble fluid to self-level and be available for bubble production in a 360 degree orientation, and allows the user to use the toy as a ball for play.

SUMMARY

An embodiment of a system is designed to produce bubbles. In one embodiment, a bubble producing system includes a reservoir, a pump, a swiping mechanism, and a fan. The reservoir is configured to store fluid and is in fluid communication with an opening. The pump is in fluid communication with the reservoir, and the pump is configured to provide pressure on the stored fluid in the reservoir such that the pump causes the stored fluid to travel to the opening. The swiping mechanism is positioned near the opening and is configured to contact the fluid that exits the opening. The swiping mechanism spreads across the fluid to create a fluid sheet. The fan is positioned near the opening, where the fan blows on the fluid sheet, thereby transforming the fluid sheet into a bubble.

BRIEF DESCRIPTION OF THE DRAWINGS

Figure (FIG.) 1 illustrates a perspective view of a bubble producing system, according to an embodiment.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

One embodiment includes a bubble producing system that is designed to produce bubbles. The bubble producing system may be used as a children's toy, a special effects machine, an art performance prop, a party entertainment item, or a similar object for entertaining users. Examples include balls such as soccer balls, basketballs, footballs, beach balls, and concert tossing balls; toys such as bubble guns, bubble musical instruments, remote control toys, bubble toys; games such as passing and tossing games, games with rolling items, Bluetooth connected passing toys, and "Jenga" bubbles; plush toys; novelty items such as backpacks, flip flops, hula hoops, boomerangs, night lights, sunglasses, sombreros, hats, toy watches; among others. The bubble producing system may receive and store a fluid for producing bubbles, such as a mixture of soap and water, commercial bubble fluid, or a similar fluid suitable for producing bubbles. Using the fluid, the bubble producing system may produce bubbles at a constant flow rate, at random or specified intervals, or in response to a user input or a trigger event, or some combination thereof. The bubble producing system is designed to produce bubbles regardless of the orientation of the system. The bubble producing system includes a pressurized system that enables the stored fluid to be available for bubble production at any orientation of the system. In this configuration, the bubble producing system may be moved, rotated, thrown, bounced, swung, etc. by a user and produce bubbles during its motion. Generally, any product that may use a fluid delivery method may be integrated with the bubble producing system.

Figure 1:
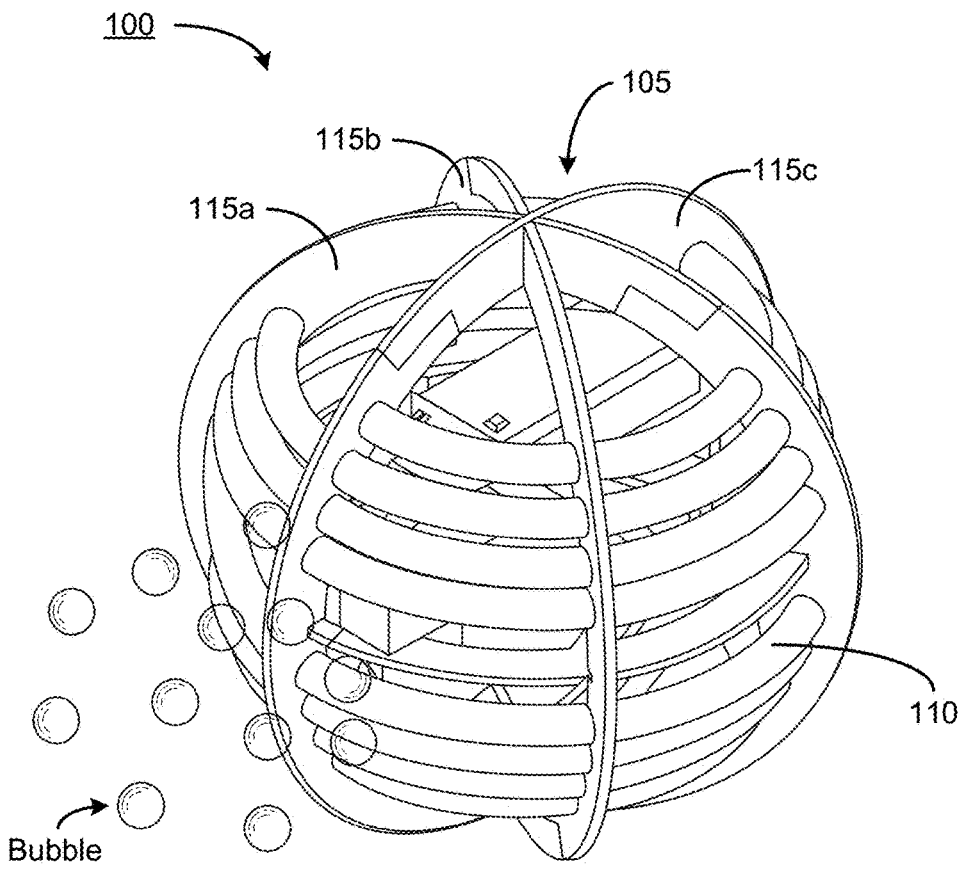

FIG. 1 illustrates a perspective view of a bubble producing system 100, according to an embodiment. The system 100 produces bubbles that flow out of the system 100. In the embodiment of FIG. 1, the system 100 includes a frame 105 and a reservoir 110, among other components that are discussed with FIGS. 3-5. In some embodiments, the system 100 may include a housing (not shown) that encloses all or a portion of the system 100.

The frame 105 provides support for the components of the system 100. In the embodiment of FIG. 1, the frame 105 provides an outer structure for securing the reservoir 110 and maintains an internal cavity for housing internal components. As illustrated in FIG. 1, the frame 105 includes three frame components 115*a*, 115*b*, 115*c* (collectively referred to as "115" hereinafter) that are substantially ring-shaped and couple to each other. The frame components 115 may be coupled together via a securing mechanism, such as adhesive, a molded component that receives a portion of each structure, mechanical fasteners, or other suitable securing mechanisms. Once coupled, the frame components 115 together form a substantially spherical frame to which the reservoir 110 is coupled. In alternate embodiments, the shape and number of frame components that form the frame 105 may vary. For example, the frame components may be shaped as ovals, squares, rectangles, or other suitable polygonal shapes. In some embodiments, the frame components may not be uniformly shaped and may form different cross-sections of a shape. For example, the frame components may form different cross-sections of an object such that each frame component has a varying width or length (e.g., forming the shape of a football). The frame 105 is discussed in further detail with regards to FIG. 2.

The reservoir 110 stores fluid for producing bubbles. In the embodiment of FIG. 1, the reservoir 110 is composed of tubing. The tubing has an internal passage configured for fluid passage. The tubing is designed to store and allow fluid to move freely throughout the system 100. As illustrated in FIG. 1, the tubing is coiled such that it wraps around and couples to the frame 105, forming an outer boundary around the internal cavity. In alternate embodiments, the tubing may be arranged or formed into a plurality of shapes. For example, the tubing may form geometrical shapes, shapes of animals, shapes of food, shapes of toys, etc. In this configuration, the tubing, and thus the fluid, may be distributed evenly or relatively evenly throughout the system 100. As a result, when moved or thrown, the system 100 may be able to travel along a balanced trajectory. In addition, this configuration may prevent the formation of air bubbles or pockets in the fluid in the reservoir 110. By preventing air bubbles, a continuous flow of fluid is available for bubble production.

In the embodiment of FIG. 1, the tubing includes a distal end and a proximal end (not shown in FIG. 1). The proximal end of the tubing includes an opening through which fluid exits. The opening may couple to additional components of the system 100, discussed with regards to FIG. 3, that transform the fluid into bubbles. The distal end of the tubing may be fixedly sealed via a sealing mechanism, such as an adhesive filler or a mechanical component, or the distal end may include an opening with a removable seal, through which the reservoir 110 may receive fluid to fill the reservoir 110. In alternate embodiments, a distal end of the tubing is coupled to a chamber that stores additional fluid. The chamber may be mounted within the internal cavity of the frame 105 and may include an opening through which the chamber can be filled with fluid. The opening may be sealable to prevent fluid from leaking out of the chamber. In some embodiments, the distal end of the tubing may be positioned near or coupled to the opening of the proximal end, such that additional fluid that exits the opening that is not used for bubble production may be returned to the reservoir 110. In this configuration, the system 100 is sealed, such that fluid does not leak from the system 100. The distal end of the tubing may be coupled to the opening of the proximal end via a Y-junction component, where a first branch leads to the distal end of the tubing for transporting additional fluid back to the reservoir and a second branch leads to additional components of the system 100 (discussed with regards to FIG. 3) for transporting fluid for bubble production. In alternate embodiments, the reservoir 110 may be a chamber that is in fluid communication with additional components of the system 100, discussed with regards to FIG. 3, that transform the stored fluid into bubbles. In some embodiments, the reservoir 110 may be a compact assembly of tubing that is coupled within the internal cavity rather than inserted into the frame 105. In the embodiments in which the reservoir 100 is tubing, the tubing may have an inner diameter between approximately 1/16 inches to ½ inches and an outer diameter between approximately ¼ inches to ¾ inches. The tubing may be composed of rubber, silicone, resin, latex, or other suitable materials for forming a passage for controlled fluid dynamics.

In some embodiments, the system 100 may be designed to produce other effects, such as fog, snow, etc., or to distribute other substances, such as glitter, colored powder, etc., for entertainment of a user. In these embodiments, the reservoir 110 is designed to hold the respective substance.

Figure 2:
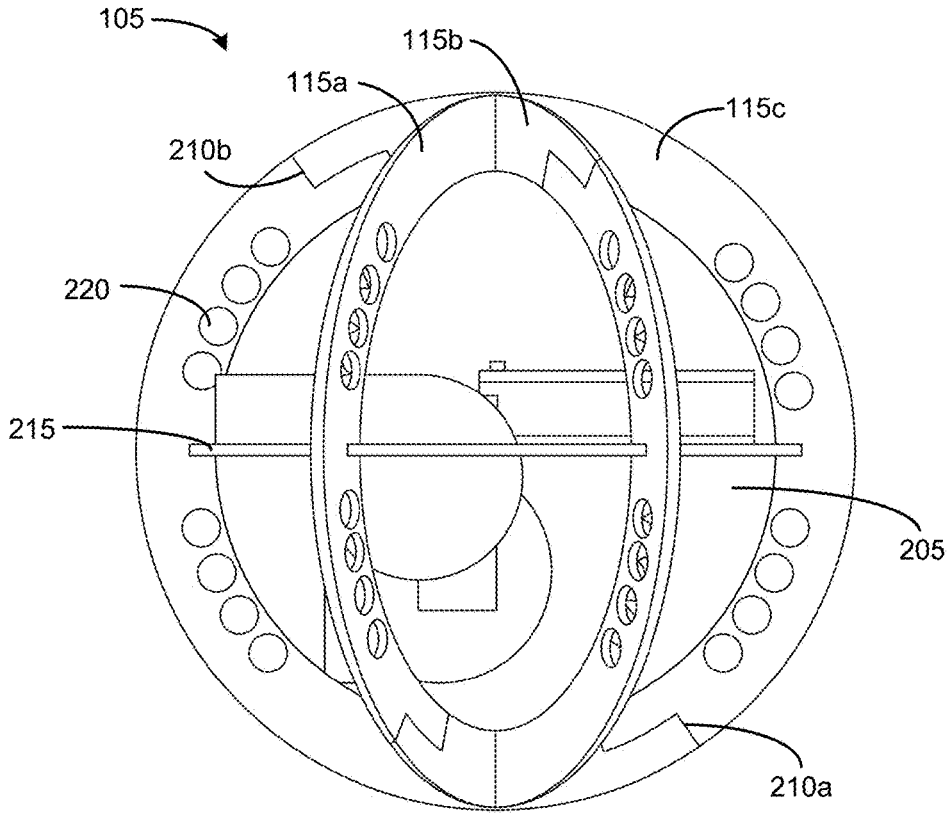
FIG. 2 illustrates a side view of a frame for securing a reservoir of the bubble producing system, according to an embodiment.

FIG. 2 illustrates a side view of the frame 105 for securing the reservoir 110 of the bubble producing system 100, according to an embodiment. As described with regards to FIG. 1, the frame 105 includes three frame components 115*a*, 115*b*, 115*c*. The frame components 115 are designed to couple together to form a support structure for the system 100. The frame components 115 are designed such that, once coupled together, the frame components 115 form an internal cavity 205 for housing the internal components of the system 100. In the embodiment of FIG. 2, the frame components 115 are substantially ring-shaped. In alternate embodiments, the shape of each frame component 115 and number of frame components 115 may vary, as described with regards to FIG. 1. The frame 105 may be composed of rigid or semi-rigid materials, such as hard plastics, wood, particleboard, or other suitable materials.

In some embodiments, each frame component 115 may be composed of smaller segments that are designed to be assembled. In FIG. 2, each frame component 115 is composed of two segments that are coupled along respective interfaces 210*a*, 210*b* (collectively referred to as "210" hereinafter). The interfaces 210 enable the frame component 115 to be assembled and interlock with each other. The interfaces 210 provide a surface along which the segments may be secured with a securing mechanism, such as adhesive or mechanical fastener, or the interfaces 210 may be designed to have complementary surfaces that snap together, or some combination thereof. While each frame component 115 in FIG. 2 includes two segments, the number of segments may vary in alternate embodiments. In alternate embodiments, each frame component 115 may have a unitary structure, where it's integrally formed of a single piece.

The frame 105 may include additional support features that span across the internal cavity 205. As illustrated in FIG. 2, a support beam 215 spans across the internal cavity 205 between portions of a frame component 115. The support beam 215 may improve the rigidity of the frame 105 and/or may provide a surface onto which the internal components of the system 100 may be coupled. The support beam 215 may be a beam that spans between portions of a frame component 115 or may be shaped such that the support beam 215 spans between two or more of the frame components 115 (e.g., disk-shaped or circular with spokes). The support beam 215 may be integrated with the frame component 115 or may be a separate component that couples to the frame component 115 via a securing mechanism (e.g., adhesive, mechanical fastener, notches that interlock, or other suitable securing mechanisms). While FIG. 2 illustrates a single support beam 215 positioned horizontally across the frame 105, alternate embodiments may include two or more support beams 215 oriented across the internal cavity 205 (in a paralleled or unparalleled fashion).

In the embodiment of FIG. 2, each frame component 115 includes a plurality of holes that are each designed to receive a portion of the coiled tubing of the reservoir 110. As illustrated in FIG. 2, each frame component 115 in this embodiment includes sixteen holes, such as hole 220, that are positioned around the circumference of the ring. The holes of each frame component 115 are located such that they are substantially aligned with corresponding holes of adjacent frame components 115. In this configuration, the tubing of the reservoir 110 is coupled within the holes in a substantially parallel fashion as the tubing wraps around the frame 105. In some embodiments, tubing of the reservoir 110 is threaded through each hole sequentially. In alternate embodiments, each hole may comprise a slit or opening through which the tubing can be inserted, enabling the tubing to be seated within each hole. The number and shape of holes in each frame component 115 may vary based on various factors, such as the length of the coiled tubing of the reservoir 110, the distribution and/or spacing of the coiled tubing throughout each frame component 115, the diameter of the tubing, or other similar aspects. In alternate embodiments, each frame component 115 may include a slot as opposed to a series of holes. For example, the frame component 115 may include a slot that effectively combines each group of four holes illustrated in FIG. 2 or a subset of the group of four holes. In some embodiments, each frame component 115 may include some combination of slots and holes for securing the reservoir 110.

The frame 105 is designed for an embodiment in which the reservoir 110 comprises coiled tubing. Alternate embodiments of the reservoir 110 may have different configurations of the frame 105. For example, the frame may be designed as an enclosure that includes a plurality of mounting features on an internal surface of the enclosure. The mounting features may include protrusions, brackets, molded features, or similar structures that are designated for receiving and/or securing components within the frame and may be used in combination with securing mechanisms, such as mechanical fasteners, adhesives, threaded interfaces, or other suitable securing mechanisms.

Figure 3:
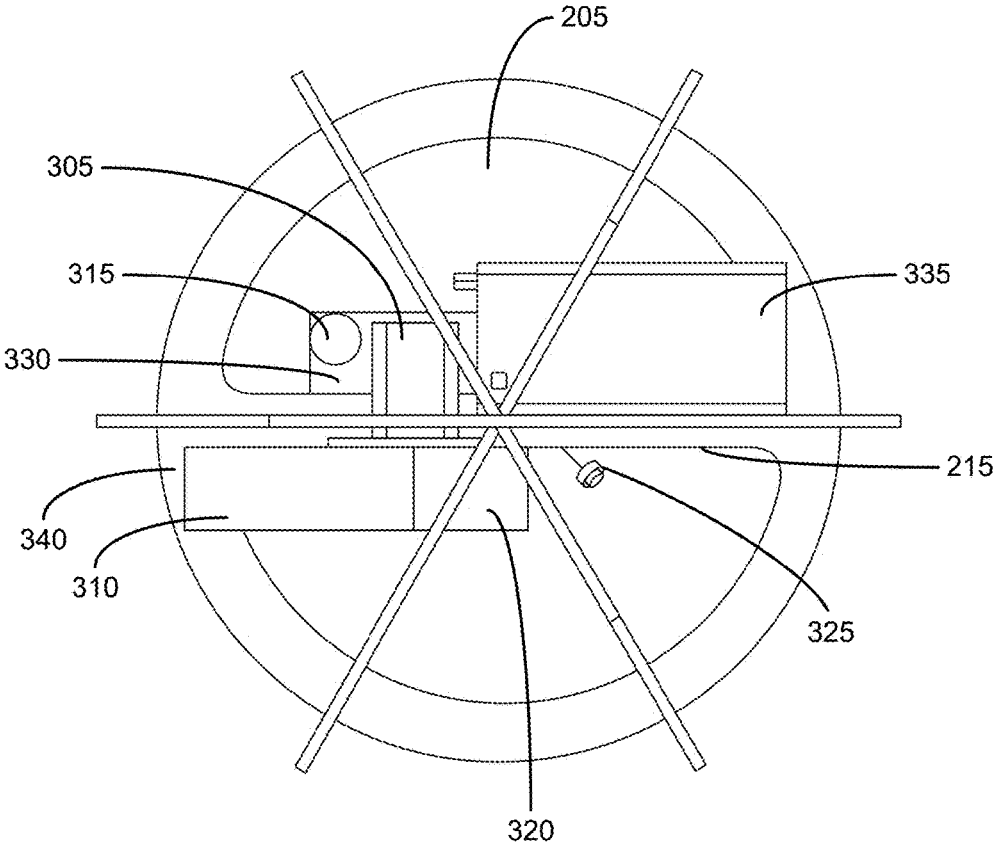
FIG. 3 illustrates a side view of operational components of the bubble producing system, according to an embodiment.

FIG. 3 illustrates a side view of operational components of the bubble producing system 100, according to an embodiment. The operational components are mounted within the internal cavity 205 of the frame 105. One or more of the operational components may be mounted to the support beam 215, as illustrated in FIG. 3. The operational components may be mounted such that the weight of the operational components are distributed substantially evenly, enabling the system 100 to have a balanced center of gravity. In the embodiment of FIG. 3, the operational components include a pump 305, a swiping mechanism 310, a motor 315, a fan 320, a motion sensor 325, a circuit board 330, and a power supply 335. Together, the operational components enable the system 100 to transform fluid stored in the reservoir 110 to bubbles.

The pump 305 provides pressure to fluid stored in the reservoir 110. The pump 305 is in fluid communication with the reservoir 110. In the embodiment of FIG. 1, the pump 305 includes a coupling element to which the reservoir 110 couples on a first side of the pump 305. The coupling element may be an opening, a male-female interference fit (e.g., press fit or friction fit), a clamp, or some combination thereof. In some embodiments, the coupling element may be integrated with the pump 305 and have a unitary structure formed during manufacturing to reduce cost. In some embodiments, the reservoir and the coupling element may be integrated and have a unitary structure formed during manufacturing to reduce cost. For example, the components may be molded together through compression molding, injection molding, heat pressure, or other suitable manufacturing methods. In one embodiment, the coupling element includes an opening into which the reservoir 110 is inserted. The proximal end or a length of the tubing may be inserted into the pump 305. The coupling element may include a clamping mechanism that contacts the external surface of the tubing to secure the tubing. In some embodiments, the coupling element may include (in lieu of or in addition to the clamping mechanism) a valve. The clamping mechanism and/or the valve may control the flow of fluid from the reservoir 110. The pump 305 also directs fluid to the swiping mechanism 310. The pump 305 may include an exit opening on a second side of the pump 305, where fluid exits the pump 305. In some embodiments, the exit opening may couple to a channel that directs the fluid to the swiping mechanism 310. In some embodiments, the exit opening directly leads the fluid to the swiping mechanism 310. In some embodiments, a valve is coupled to the exit opening to control the flow of the fluid exiting the pump 305. In some embodiments, the exit opening may be located on the same side of the pump 305 as the coupling element. In some embodiments, the reservoir 110 may be inserted into the pump 305 such that the proximal end exits the pump 305 through the exit opening. The proximal end may then couple to the swiping mechanism 310.

When the pump 305 is powered on, the pump 305 generates pressure within the reservoir 110. In the embodiment of FIG. 1, the pump 305 is a peristaltic pump that compresses and relaxes portions of a flexible tube to pump fluid through the tube. The flexible tube may be the reservoir 110 or an internal tube that couples to the reservoir 110 as described in the embodiments above. The peristaltic movement created by the pump 305 causes the stored fluid in the reservoir 110 to travel through the reservoir 110 and travel towards the opening at the proximal end of the reservoir 110, where the fluid exits the reservoir 110. In this configuration, the pump 305 enables fluid stored in the reservoir 110 to be available in a continuous or regulated flow for bubble production. As a result, stored fluid in the reservoir 110 is available for bubble production regardless of the orientation of the system 100. The pump may be activated in accordance with instructions from the circuit board 330.

The swiping mechanism 310 is configured to create a fluid sheet from fluid that exits the reservoir 110. The fluid sheet is a layer of fluid that may be transformed into a bubble. The fluid sheet may be relatively thin and/or flat, such that, when blown on by the fan 320, the fluid sheet forms a thin skin or wall around the air and captures air within it. In one embodiment, the swiping mechanism 310 is positioned to abut a surface 340 positioned at the opening at the proximal end of the reservoir 110. The surface 340 collects fluid that exits the reservoir 100. In the embodiment of FIG. 3, the swiping mechanism 310 is a segment comprising a side and/or an edge. The segment may be rectangular, square, or other suitable shape that includes at least one side or edge that is shaped to complement the surface 340, allowing the segment to swipe across the surface 340 to create the fluid sheet.

In the embodiment of FIG. 3, the swiping mechanism 310 is mounted via a shaft that enables the swiping mechanism 310 to rotate about a rotational axis. The shaft may be rotatably mounted to the frame 105, the pump 305, the proximal end of the reservoir 110, or another component suitable for coupling the swiping mechanism 310 to the reservoir 110. The rotational axis of the swiping mechanism 310 is substantially aligned with the shaft. In one embodiment, the shaft is perpendicular to the length of the swiping mechanism 310. The shaft may be positioned along the length of the swiping mechanism 310, for example, nearer to an end of the swiping mechanism 310 or near a center of the swiping mechanism 310. In one embodiment, the segment may include one or more protrusions that protrude from a surface of the swiping mechanism 310. In this configuration, the shaft is aligned through the one or more protrusions such that the rotational axis is parallel to the length of the swiping mechanism 310. In one embodiment, the swiping mechanism 310 rotates about its rotational axis between a range of approximately 0 to 180 degrees. In this embodiment, the swiping mechanism 310 may rotate back and forth (clockwise direction to counter-clockwise direction, and vice versa) within that range. In one embodiment, the swiping mechanism 310 may rotate 360 degrees in a clockwise or counter-clockwise direction. In either embodiment, with each rotation of the swiping mechanism 310, the swiping mechanism 310 contacts the fluid that collects on the surface 340. As a result, the swiping mechanism 310 sweeps across the surface 340 and spreads out the fluid to create the fluid sheet. Spreading out the fluid into a fluid sheet increases a surface area of the fluid, such that the fluid may be transformed into a bubble. Embodiments of the swiping mechanism 310 are discussed in further detail with regards to FIGS. 6-7.

The motor 315 causes rotation of the swiping mechanism 310. The motor 315 is coupled to the shaft of the swiping mechanism 310, either directly connected or coupled via a gear assembly, a pulley system, or other suitable coupling mechanisms for transferring torque from the motor to the shaft of the swiping mechanism 310. The motor 315 may rotate the swiping mechanism 315 in accordance with instructions from the circuit board 330. The motor 315 may rotate the swiping mechanism 310 in a 360-degree circle in a clockwise or counter-clockwise direction, in an alternating direction, or some combination thereof. The motor 315 may rotate the swiping mechanism 310 continuously, at random or specified intervals, or some combination thereof.

The fan 320 transforms the fluid sheet created by the swiping mechanism 310 into a bubble. The fan 320 is positioned near the swiping mechanism 310 such that airflow created by the fan 320 blows on the fluid sheet created by the swiping mechanism 310. In some embodiments, the fan 320 is positioned near an edge of the surface 340 on which fluid collects once the fluid exits the opening of the reservoir 110, the pump 305, or a channel coupled to the pump 305 that directs the fluid to the surface 340. The fan 320 may be mounted to the frame 105, to the swiping mechanism 310, to the pump 305, to the reservoir 110, or another component suitable for positioning the fan 320 near the swiping mechanism 310. The fan 320 is oriented such that, when activated, the fan 320 blows on the fluid sheet created by the swiping mechanism 310. The airflow created by the fan 320 causes the fluid sheet to transform into a bubble. The fan 320 may be activated in accordance with instructions from the circuit board 330. The fan 320 may be activated continuously, at random or specified intervals, in synchronous with the activation of the motor 315 that causes rotation of the swiping mechanism 310, or some combination thereof.

The motion sensor 325 detects motion of the system 100. The motion sensor 325 may detect the system 100 being moved, rotated, thrown, bounced, swung, etc. by a user. Upon detecting motion, the motion sensor 325 triggers operation of the system 100. As a result, the system 100 may begin to produce bubbles. In some embodiments, the system 100 may include one or more components for special effects (e.g., lights, music, shaking, etc.) that may synchronously activate. In some embodiments, the system 100 may include a switch that activates operation of the system 100. The switch may be a button, a switch, a pull string, or a similar trigger mechanism designed to be actuated by a user. When actuated, the switch activates the pump 305, the motor 315, the fan 320, or some combination thereof. The system 100 may include the switch in lieu of or in addition to the motion sensor 325.

The circuit board 330 controls the operation of the system 100. The circuit board 330 electrically connects the operational components of the system 100, such as the pump 305, the swiping mechanism 310, the motor 315, the fan 320, the motion sensor 325, and the power supply 335. The circuit board 330 may be a printed circuit board that has a microcontroller with firmware to dictate its operation. The inputs to the circuit board 330 include the motion sensor 325 and the power supply 335, and the outputs from the circuit board 330 include the pump 305, the motor 315, and the fan 325. The circuit board 330 controls the activation and deactivation of the pump 305, the motor 315, and the fan 325. The circuit board 330 may generate instructions to activate and deactivate these components synchronously (e.g., at the same time or in a specified sequence with specified time delays in between) such that stored fluid in the reservoir 110 is available for bubble production and is then transformed into bubbles. The circuit board 330 may activate each component for a predetermined amount of time, continuously, or at specified or random intervals, or some combination thereof. In some embodiments, the circuit board 330 activates these components in response to receiving a trigger signal. In some embodiments, the trigger signal is received from the motion sensor 325, a switch actuated by a user, or some combination thereof.

The power supply 335 powers the operation of the system 100. The power supply may comprise a plurality of removable standard batteries that are electrically coupled to the circuit board 330. The number and types of batteries may vary, in terms of different voltages, different configurations such as in series or in parallel, high energy, long lasting, rechargeable, etc.

Figure 4:
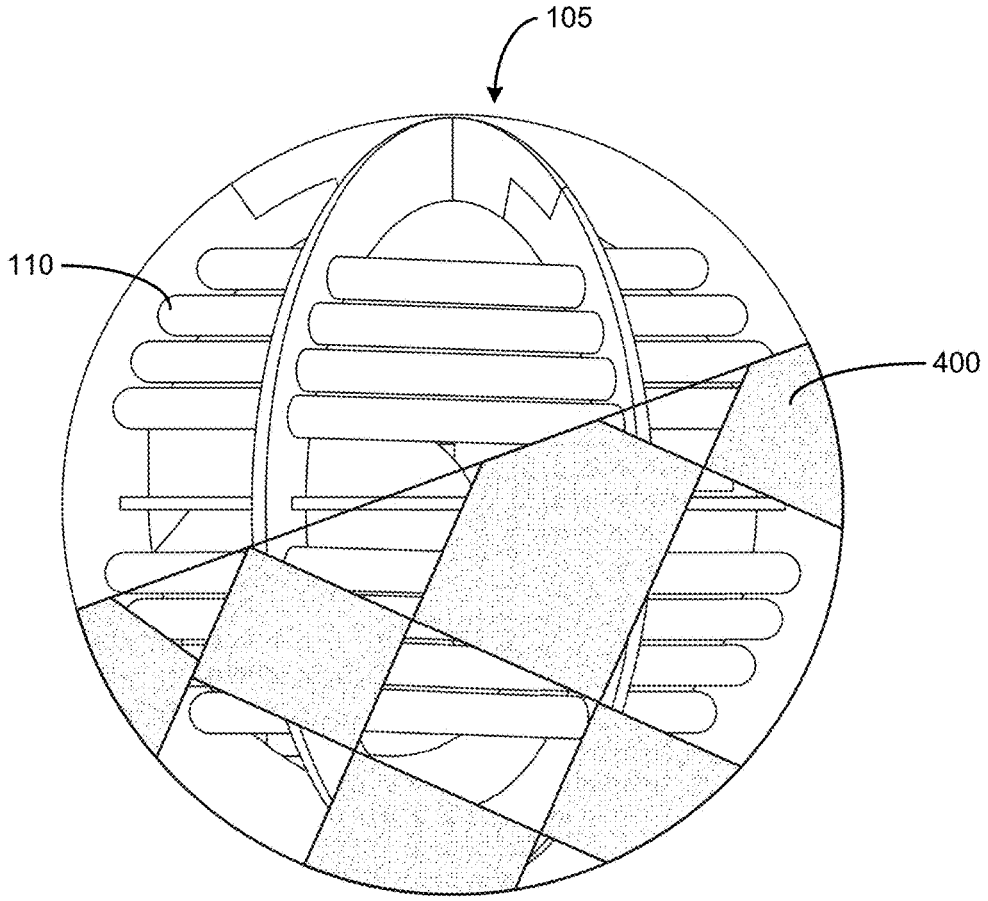
FIG. 4 illustrates a portion of a housing for the bubble producing system, according to an embodiment.

FIG. 4 illustrates a portion of a housing 400 for the bubble producing system 100, according to an embodiment. The housing 400 may be an external shell that encapsulates all or a portion of the frame 105, with the reservoir 110 and internal components coupled to the frame 105. The housing 400 may be a decorative and/or protective shell comprised of a plurality of segments that couple together. While a portion of the housing 400 is shown in FIG. 4, the housing 400 may include a complementary portion that is designed to couple or interlock with the portion shown in FIG. 4. In alternate embodiments, the housing 400 may be assembled from three or more components. In the embodiment of FIG. 4, the housing 400 includes a plurality of openings. At least one of the openings may be aligned with the swiping mechanism 310 to allow bubbles created by the system 100 to emerge from the housing 400 and float freely within a surrounding environment. In FIG. 4, the plurality of openings are shaped in an alternating pattern of diamonds. The shape and design of the pattern may vary in alternate embodiments. For example, the housing 400 may be decorated or shaped in accordance with a theme. Example themes may be based on sports or popular children's cartoons, characters, television shows, movies, or similar. The housing may solid or inflatable and be composed of rigid materials (e.g., hard plastics, wood, metal, etc.), soft materials (e.g., foam, rubber, silicone, paper, etc.), other suitable materials, or some combination thereof.

Figure 5:
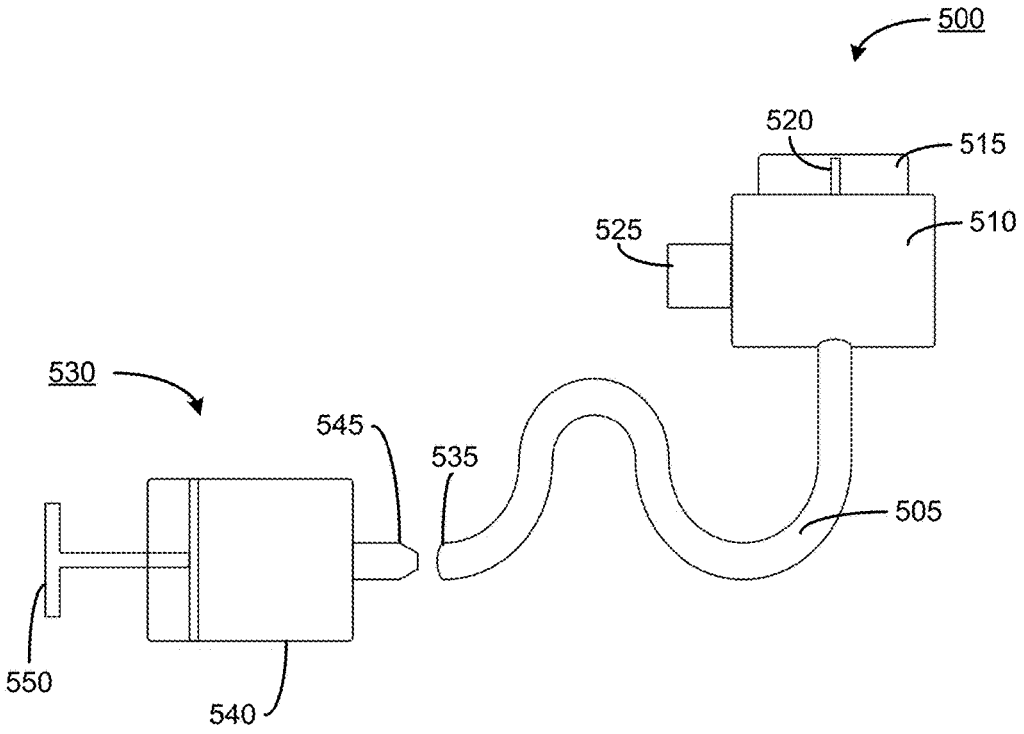
FIG. 5 illustrates an embodiment of a bubble producing system and an instrument for filling the bubble producing system with fluid, according to an embodiment.

FIG. 5 illustrates an embodiment of a bubble producing system 500 and an instrument 530 for filling the bubble producing system with fluid, according to an embodiment. The bubble producing system 500 produces bubbles that flow out of the system 500. The system 500 may be an embodiment of the system 100. Specifically, the system 500 includes a portion of the components of system 100 in an alternate configuration. In the embodiment of FIG. 5, the system 500 includes a reservoir 505, a pump 510, an exit surface 515, a swiping mechanism 520, and a power source 525. FIG. 5 also illustrates the instrument 530 for filling the system 500. The system 500 may be designed to be held by a user by the pump 510, and the reservoir 505 may be configured to hang from the pump 510 in a snake-like manner. The system 500 may be thrown via the pump 510, with the reservoir 505 trailing behind it. Alternatively, a user may hold the system 500 by the reservoir 505, and, for example, swing the system 500 around by the reservoir 505. During motion of the system 500, the system 500 is able to produce bubbles. In alternate embodiments, FIG. 5 illustrates the system 500 without a frame or housing and with the reservoir 505 in an uncoiled configuration.

As illustrated in FIG. 5, the exit surface 515 couples to a side of the pump 510, and the swiping mechanism 520 is positioned on the exit surface 515. The power source 525 is secured to a second side of the pump 510. The reservoir 505 is coupled to a third side of the pump 510. FIG. 5 illustrates the location of these components as an example arrangement, and the arrangement may vary in other embodiments. In the embodiment of FIG. 5, the reservoir 505 includes a valve 535 at a distal end of the reservoir 505. The valve 535 may be a one-way valve that allows the reservoir 505 to be filled with fluid and prevents the fluid from exiting the reservoir 505. As illustrated in FIG. 5, the pump 510 is coupled to a proximal end of the reservoir 505. In this configuration 510, the pump 510 applies pressure to draw fluid stored in the reservoir 505 towards the pump 510. The fluid travels through the pump 510 to the exit surface 515, where the swiping mechanism 520 moves across the fluid collected on the exit surface 515 and spreads the fluid into a fluid sheet. The system 500 may also include a fan (not shown) that blows on the fluid sheet to transform the fluid sheet into bubbles.

In the embodiment of FIG. 5, the instrument 530 may be configured to draw in fluid from, for example, a supply container and deliver fluid to the reservoir 505. The instrument 530 includes a chamber 540, a nozzle 545 and a plunger 550. The chamber 540 may be a barrel that holds fluid for filling the reservoir 505. At a proximal end of the chamber 540, the nozzle 545 directs the flow of fluid into and out of the chamber 540. The nozzle 545 is configured to couple to the reservoir 505 via the valve 535 such that the chamber 540 and reservoir 505 are in fluid communication. Once in fluid communication, the plunger 550 may be depressed to deliver fluid from the instrument 530 to the reservoir 505. The plunger may be actuated in an opposite direction to draw fluid into the chamber 540.

Figure 6:
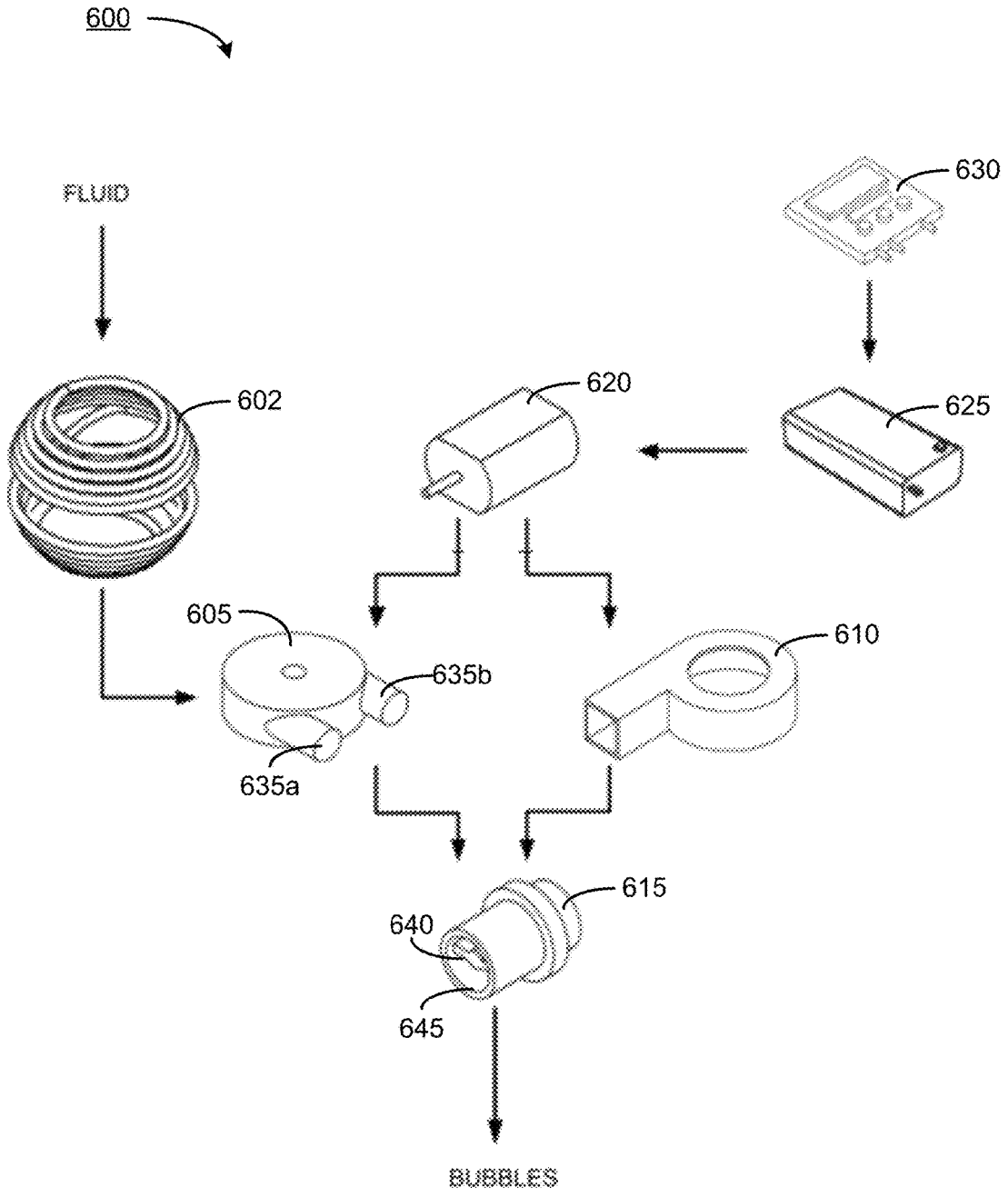
FIG. 6 illustrates components of a bubble producing system, according to an embodiment.

FIG. 6 illustrates components of a bubble producing system 600, according to an embodiment. The system 600 is an embodiment of the system 100. The description for FIGS. 1-5 for corresponding components of system 100 is incorporated herein for system 600. The system 600 is illustrated with its individual components separated and arranged approximately in a flowchart. In the embodiment of FIG. 6, the system 600 includes a reservoir 602, a pump 605, a fan 610, a swiping mechanism 615, a motor 620, a battery 625, and a sensor 630, among other components not shown in FIG. 6. The system 600 is triggered by the sensor 630, which detects motion of the system 600. Once the sensor 630 detects motion of the system 600, the battery 625 provides power to the motor 620, the pump 605, the fan 610, the swiping mechanism 615, or some combination thereof, activating the components and enabling the system 600 to transform fluid into bubbles. Fluid is stored in the reservoir 602, and, upon activation, the pump 605 draws the fluid from the reservoir 602 towards the pump 605. The pump 605 dispenses the fluid to the swiping mechanism 615, where the swiping mechanism 615 creates a fluid sheet from the fluid. The fan 610 blows on the fluid sheet to create bubbles.

In the embodiment of FIG. 6, the reservoir 602 is a coiled tubing. The tubing has a proximal end and a distal end (not shown in FIG. 6), and the proximal end couples to the pump 605. FIG. 6 illustrates the pump 605 having a first port 635*a* and a second port 635*b*. At least one port 635 is configured to couple to the proximal end of the tubing of the reservoir 602. At least one port is configured to couple to the swiping mechanism 615 such that fluid from the reservoir 602 exits the pump 605 and is delivered to the swiping mechanism 615. The fan 615 creates an airflow and directs the airflow to the swiping mechanism 615. In the embodiment of FIG. 6, the swiping mechanism 615 includes a tube that is cylindrical-shaped. The tube may be coupled to a port 635 of the pump 605, directly or with a coupling tube or channel. Inside the tube of the swiping mechanism 615, a segment 640 is rotatably mounted. The segment 640 includes a shaft that aligns with a central axis of the tube. The segment 640 comprises an edge configured to abut an internal surface of the tube. In some embodiments, the segment 640 may include more than one edge protruding from the shaft that is configured to abut the internal surface of the tube. As fluid flows from the pump 605 to the swiping mechanism 615, the fluid flows through the tube, and the segment 640 rotates to spread out the fluid across the internal surface of the tube. Due to surface tension properties of the fluid, spreading out the fluid along the internal surface of the tube creates a fluid sheet across an opening 645 of the tube. Airflow from the fan 610 travels through the tube of the swiping mechanism 615 and blows on the fluid sheet, transforming it into a bubble that departs from the swiping mechanism 615.

Figure 7:
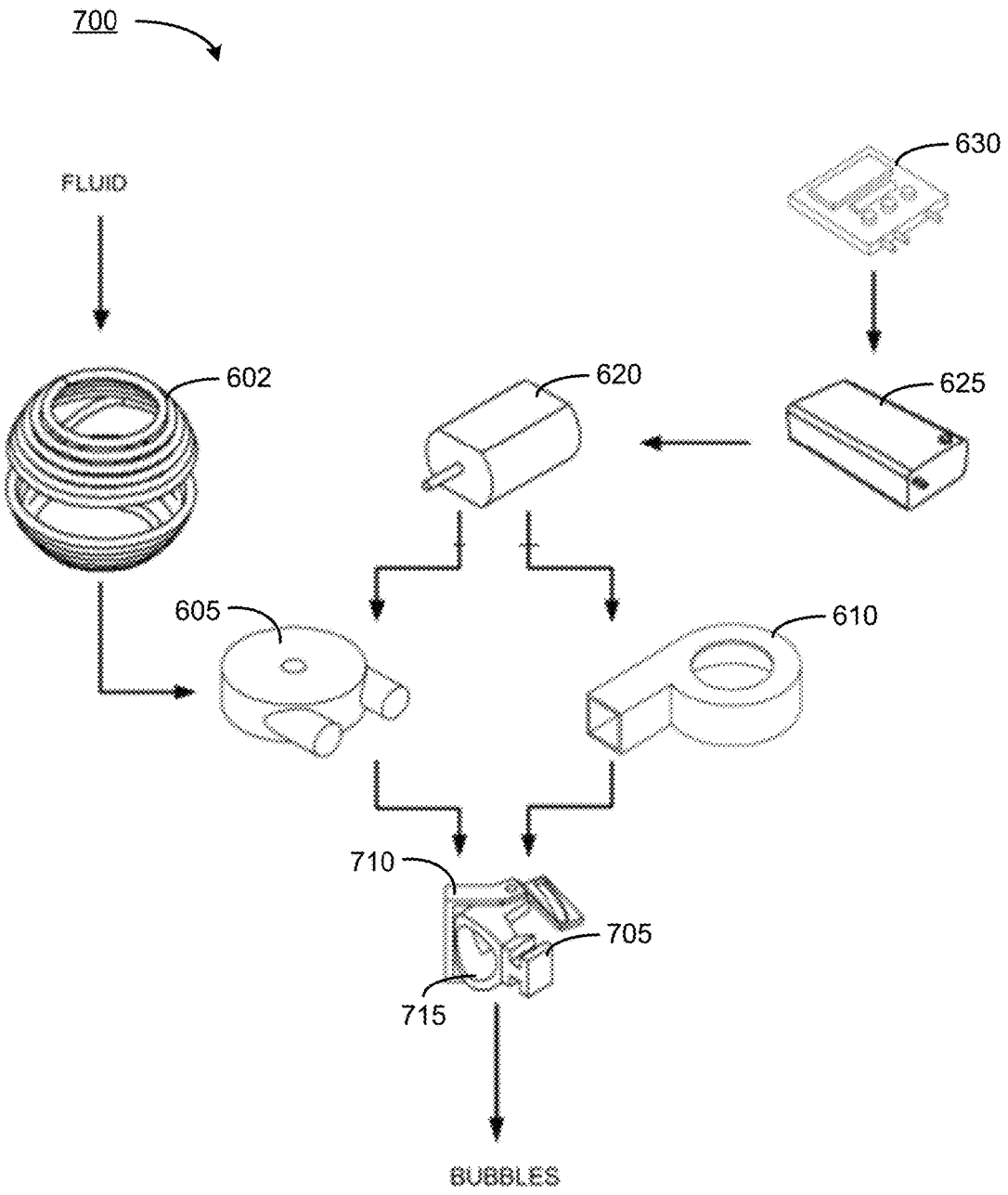
FIG. 7 illustrates components of a bubble producing system, according to an embodiment.

FIG. 7 illustrates components of a bubble producing system 700, according to an embodiment. The system 700 is an embodiment of system 100 and system 600. The system 700 is similar to system 600 illustrated in FIG. 6, and described above, except as detailed below. In the embodiment of FIG. 7, the system 700 includes a reservoir 602, a pump 605, a fan 610, a swiping mechanism 705, a motor 620, a battery 625, and a sensor 630, among other components not shown in FIG. 7.

In the embodiment of FIG. 7, the swiping mechanism 705 includes a tube that is cylindrical-shaped. A segment 710 is rotatably mounted to an external surface of the tube. As illustrated in FIG. 7, the segment 710 comprises a protrusion at each end, where each protrusion is rotatably secured to the tube via a shaft. The rotational axis of the segment 710 is aligned with the shaft. The segment 710 is positioned such that it abuts an opening 715 of the tube. The segment 710 is configured to rotate left and right across the opening 715. As fluid flows from the pump 605 to the swiping mechanism 615, the fluid flows through the tube and to the opening 715, where the segment 710 rotates across the fluid to create a fluid sheet across the opening 715. Airflow from the fan 610 travels through the tube of the swiping mechanism 705 and blows on the fluid sheet, transforming it into a bubble that departs from the swiping mechanism 705.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A system comprising:

a reservoir configured to store a fluid, the reservoir comprising a distal end and a proximal end that are each sealed, the proximal end of the reservoir in fluid communication with an opening;

a pump in fluid communication with the distal end of the reservoir, wherein the pump, when activated, is configured to provide pressure on the stored fluid in the reservoir such that the pump causes the stored fluid to travel to the opening;

a swiping mechanism positioned near the opening and configured to contact fluid at the opening, wherein the swiping mechanism, when activated, spreads across the fluid to create a fluid sheet;

a fan positioned near the opening, wherein the fan, when activated is configured to blow on the fluid sheet, thereby transforming the fluid sheet into a bubble.

2. The system of claim 1, wherein the reservoir comprises tubing having an internal passage configured for fluid passage.

3. The system of claim 1, further comprising a motor configured to rotate the swiping mechanism.

4. The system of claim 3, wherein the motor is configured to rotate the swiping mechanism in at least one of the following: a clockwise direction, a counterclockwise direction, or some combination thereof.

5. The system of claim 3, wherein the motor is configured to rotate the swiping mechanism at one of the following: a constant rate, at a specified interval, and a random interval.

6. The system of claim 1, further comprising a frame that comprises a plurality of holes configured to couple at least a portion of the reservoir.

7. The system of claim 6, wherein the frame is composed of a plurality of frame components, wherein each frame component is substantially ring-shaped.

8. The system of claim 6, wherein the frame comprises one or more support beams for coupling at least one of the reservoir, the pump, the swiping mechanism, and the fan.

9. The system of claim 1, further comprising a motion sensor configured to detect motion of the system.

10. The system of claim 9, wherein, in response to detecting motion of the system, a controller is configured to activate the pump, the swiping mechanism, and the fan.

11. The system of claim 1, further comprising a housing that encapsulates all of the system.

12. The system of claim 1, further comprising an exit surface positioned at the opening, wherein the exit surface collects fluid from the reservoir.

13. The system of claim 12, wherein the swiping mechanism comprises a flat surface configured to abut the exit surface such that the flat surface spreads out fluid on the exit surface, thereby creating the fluid sheet.

14. The system of claim 12, wherein the fan is positioned at an edge of the exit surface.

15. The system of claim 1, wherein the reservoir comprises a one-way valve at a distal end, wherein the valve is configured to receive fluid from a filling instrument and prevent fluid from exiting the reservoir.

16. A system comprising:

a reservoir configured to store a fluid, the reservoir comprising a distal end and a proximal end that are each sealed, the proximal end of the reservoir in fluid communication with an opening, the distal end of the reservoir configured to fluidly couple to a pump that is configured to provide pressure on the stored fluid in the reservoir;

a swiping mechanism positioned near the opening and configured to contact fluid at the opening, wherein the swiping mechanism, when activated, spreads across the fluid to create a fluid sheet; and a fan positioned near the opening, wherein the fan, when activated is configured to blow on the fluid sheet, thereby transforming the fluid sheet into a bubble.

17. The system of claim 16, wherein the pump, when activated, is configured to provide the pressure on the stored fluid such that the stored fluid travels toward the opening.

18. The system of claim 16, further comprising a motor configured to rotate the swiping mechanism.

19. The system of claim 18, wherein the motor is configured to rotate the swiping mechanism in at least one of the following: a clockwise direction, a counterclockwise direction, or some combination thereof.

20. The system of claim 16, further comprising a motion sensor configured to detect motion of the system.

* * * * *